US007919734B2

(12) United States Patent
Sakurai et al.

(10) Patent No.: US 7,919,734 B2
(45) Date of Patent: Apr. 5, 2011

(54) METHOD FOR MANUFACTURING CERAMIC HEATER AND CERAMIC HEATER

(75) Inventors: Kikuo Sakurai, Ogaki (JP); Eiji Kakamu, Minokamo (JP)

(73) Assignee: NGK Spark Plug Co., Ltd., Aichi (JP)

( * ) Notice: Subject to any disclaimer, the term of this patent is extended or adjusted under 35 U.S.C. 154(b) by 767 days.

(21) Appl. No.: 11/781,592

(22) Filed: Jul. 23, 2007

(65) Prior Publication Data

US 2008/0023467 A1 Jan. 31, 2008

(30) Foreign Application Priority Data

Jul. 24, 2006 (JP) ..... P 2006-201041

(51) Int. Cl.
*H05B 3/10* (2006.01)
*B28B 1/00* (2006.01)

(52) U.S. Cl. ..... 219/553; 219/541; 219/542; 219/544; 219/545; 219/552; 219/444.1; 428/446; 428/448; 338/306; 338/308; 338/310; 338/312; 338/314; 264/614

(58) Field of Classification Search ..... 219/541–553, 219/444.1; 428/446–448; 338/306–314; 264/614
See application file for complete search history.

(56) References Cited

FOREIGN PATENT DOCUMENTS

JP 2003-317907 * 11/2003
JP 2003-317907 A 11/2003

* cited by examiner

*Primary Examiner* — Shawntina Fuqua
(74) *Attorney, Agent, or Firm* — Sughrue Mion, PLLC

(57) ABSTRACT

A ceramic heater includes a core material and a ceramic sheet covering the core material, and wherein a side of the ceramic sheet opposite the core material is an outer side of the ceramic heater. A method for manufacturing the ceramic heater includes forming a through hole in a ceramic sheet which is diametrically enlarged from a first surface toward a second surface of the ceramic sheet, forming a via conductor, forming on the second surface a heating portion and lead portion for connecting the heating portion and the via conductor, and covering a core material with the ceramic sheet such that the first surface faces an outer side of the ceramic heater.

12 Claims, 12 Drawing Sheets

Fig. 12

| | Punching Direction | Via Filling Direction | Rate of Occurrence of Cracks |
|---|---|---|---|
| Manufacturing Method 1 | From the second surface side | From the first surface side | 100% |
| Manufacturing Method 2 | From the first surface side | From the first surface side | 20% |
| Manufacturing Method 1 | From the first surface side | From the second surface side | 9% |

METHOD FOR MANUFACTURING CERAMIC HEATER AND CERAMIC HEATER

BACKGROUND OF THE INVENTION

1. Field of the Invention

The present invention relates to a cylindrical ceramic heater formed by covering a core material with a ceramic sheet.

2. Description of the Related Art

Conventionally, in a ceramic heater which is formed by covering a core material with a ceramic sheet, a heating element is embedded in the ceramic sheet. Concurrently, a lead portion connected to a rear end side of the heating element is also embedded in the ceramic sheet. The lead portion is connected to an electrode pad formed on the outer peripheral side in the cylindrical ceramic sheet through a via conductor in a through hole formed in the ceramic sheet, thereby realizing electrical conduction to the heating element (refer to FIG. 2 of JP-A-2003-317907, among others).

3. Problems to be Solved by the Invention

Although a through hole must be formed in advance in the ceramic sheet to realize electrical conduction to the heating element, in terms of the structure in which the core member is covered with the ceramic sheet, a problem arises in that stress which enlarges the through hole in the circumferential direction occurs while covering the core member with the ceramic sheet. Consequently, a crack is likely to occur in the through hole and its periphery.

The reason is as follows.

The through hole is formed as the ceramic sheet is punched from its obverse surface toward its reverse surface by a processing tool (punch). At this time, considering the inner peripheral surface of the through hole, the obverse surface side of the ceramic sheet is formed into a smooth planar surface conforming to the surface of the tool. However, the reverse surface side is pulled by the tool and can fall off. Thus, there are cases where the inner peripheral surface of the through hole ceases to be smooth.

As for the via conductor which is embedded in the through hole in such a state, since the reverse surface side of the ceramic sheet at the through hole is not smooth, the adhesive force between the via conductor and the inner peripheral surface of the through hole becomes weaker than on the obverse surface side of the ceramic sheet.

Then, if a core member is covered with this ceramic sheet with its reverse surface side set as an outer surface, stress is applied in a direction in which the inner peripheral surface of the through hole and the via conductor are stretched in the circumferential direction. However, at that time, since the adhesive force on that reverse surface side is weak, the via conductor is likely to exfoliate from the inner peripheral surface of the through hole. This in turn induces generation of a crack in the through hole and its periphery.

SUMMARY OF THE INVENTION

The present invention has been made to overcome the above-noted problems of the prior art, and an object thereof is to provide a technique for preventing the generation of cracks in a through hole of a ceramic heater and its periphery.

In accordance with a first aspect, the present invention has been achieved by providing a method of manufacturing a ceramic heater, including a core material and a ceramic sheet covering said core material, and wherein a side of the ceramic sheet opposite the core material is an outer side of the ceramic heater, said method comprising: forming a through hole in a ceramic sheet which is diametrically enlarged from a first surface toward a second surface of the ceramic sheet by punching the ceramic sheet from the first surface toward the second surface of the ceramic sheet; forming a via conductor by filling an electrically conductive paste in the through hole; forming on the second surface a heating portion and a lead portion for connecting the heating portion and the via conductor; and covering a core material with the ceramic sheet such that the first surface faces the outer side of the ceramic heater.

According to the above-described manufacturing method, the core material is covered with the ceramic sheet by setting as its outer side a punching start surface (first surface) with which a processing tool (punch) is first brought into contact when the through hole is punched.

The ceramic heater thus manufactured has a substantially lower occurrence of cracks as compared with a case where the core material is covered with the ceramic sheet by setting as its inner side the surface (second surface) with which the tool is first brought into contact, as shown by an experimental result described below.

The reason is as follows.

In the case where punching is performed from the first surface toward the second surface of the ceramic sheet, since the second surface side of the ceramic sheet at the inner peripheral surface of the through hole is no longer smooth, the adhesive force between the via conductor and the inner peripheral surface of the through hole in this region becomes weak, as described above. By contrast, in the above-described manufacturing method, the core material is covered with the ceramic sheet such that the first surface side faces the outer side of the ceramic heater. In this case, in the inner peripheral surface of the through hole on the second surface side of the ceramic sheet, as the core material is covered with the ceramic sheet, stress occurs in a direction approaching the via conductor, with the result that the adhesive force increases. Although, in the inner peripheral surface of the through hole on the first surface side of the ceramic sheet, stress occurs in a direction moving away from the via conductor, the adhesive force is stronger in this region than on the second surface side. Consequently, exfoliation between the inner peripheral surface of the through hole and the via conductor is unlikely to occur. Accordingly, with the above-described manufacturing method, it is possible to substantially lower the probability of occurrence of cracks as compared with a case where the core material is covered with the ceramic sheet by setting as its inner side the surface with which the tool is first brought into contact.

In addition, when the core material is covered with the ceramic sheet, stress directed outwardly (from the second surface toward the first surface) is applied to the via conductor filled in the through hole. Consequently, displacement can occur between the through hole and the via conductor, possibly causing a crack in the through hole and its periphery. Such stress is particularly noticeable in the case of a small-diameter heater whose outside diameter, after covering the core material with the ceramic sheet, becomes not greater than 3.0 mm. However, if the through hole is diametrically enlarged from the first surface toward the second surface, as described above, even if an outwardly directed stress is applied to the via conductor filled in the through hole when the core material is covered with the ceramic sheet, the stress can be suppressed by the inner peripheral surface of the through hole. As a result, displacement is unlikely to occur between the through hole and the via conductor, so that it is possible to further suppress the occurrence of cracks in the through hole and its periphery. As used herein, "enlargement in diameter" is satisfied if the diameter of the through hole is enlarged from the first surface toward the second surface. The "diametrically enlarged" through hole can be made according to the punching procedure shown in FIGS. 5A and 5B, discussed in detail below. As specific examples, a flared shape or a reversely tapered expanding shape may be used.

When stress is applied, if there is an irregularity on the electrically conductive paste located on the first surface side of the ceramic sheet, a crack can possibly occur from that irregularity, so that the electrically conductive paste at that position should desirably be smooth. Accordingly, in order to render smooth at least the exposed surface of the electrically conductive paste on the first surface side of the ceramic sheet, the electrically conductive paste may be filled in the through hole from the second surface side of the ceramic sheet in a state in which the first surface side of the through hole is closed by a smooth plate. As the exposed surface of the electrically conductive paste on the first surface side is rendered smooth, the stress which serves as a starting point of a crack is not produced, so that it is possible to prevent the occurrence of cracks at the time of covering the core material with the ceramic sheet.

In addition, the second surface of the ceramic sheet has a surface roughness that is preferably smaller than that of the first surface. Although the heating portion is formed on the second surface, the characteristics of the heater are determined according to its resistance value. Since the resistance value is determined by the shape (cross-sectional area, route length) of each pattern, if an irregularity is present on the second surface, there is a possibility of unintended variation in resistance value and heater characteristics. By contrast, in the case where the heating portion is formed on the surface of the ceramic sheet having the smaller surface roughness, it is possible to reduce the effects of irregularities on the heater characteristics, with the result that a heating element having the desired characteristics can be formed.

In addition, in accordance with another aspect, the present invention provides a ceramic heater comprising: a cylindrical ceramic layer extending in an axial direction; a first through hole penetrating the ceramic layer; a first via conductor filled in the first through hole; an electrode pad formed on an outer surface of the ceramic layer so as to be connected to the first via conductor; a heating portion formed on an inner surface of the ceramic layer; and a lead portion formed on the inner surface of the ceramic layer so as to connect the heating portion and the first via conductor, wherein, in a first cross section passing through a center of the first through hole and extending along the axial direction, the first through hole is diametrically enlarged from the outer surface toward the inner surface of the ceramic layer.

If the first through hole is diametrically enlarged from the outer surface toward the inner surface at least in the first cross section, even if stress directed from the inner surface side toward the outer surface side is applied to the first via conductor filled in the first through hole, the stress can be suppressed by the inner peripheral surface of the first through hole. As a result, displacement is unlikely to occur between the first through hole and the first via conductor, thereby making it possible to prevent the generation of cracks in the first through hole and its periphery. A difference in diameter of the first through hole between the outer surface and the inner surface of the ceramic layer in the first cross section is not less than 0.1 mm. Further, as for the cross-sectional shape of the first through hole, a tapered shape expanding from the outer surface toward the inner surface is most preferable. In order to provide a more reliable effect, it is preferred that, in a second cross section passing through the center of the first through hole and perpendicular to the axial direction, the first through hole is diametrically enlarged from the outer surface toward the inner surface of the ceramic layer.

In addition, the diameter at the outer surface of the first through hole is preferably not greater than 0.5 mm in the first cross section. When the diameter of the outer surface of the first through hole is set to not greater than 0.5 mm, it is possible to reduce stress applied to the first via conductor, thereby making it possible to prevent the generation of cracks.

Furthermore, the ceramic heater in accordance with the invention may further comprise: a connection terminal having a surface abutting the electrode pad; a second through hole which penetrates the ceramic layer and is diametrically enlarged from the outer surface toward the inner surface of the ceramic layer in the first cross section, said first cross section also passing through a center of the second through hole; and a second via conductor which is filled in the second through hole so as to connect the electrode pad and the lead portion, wherein a joint portion of the connection terminal is disposed between the center of the first through hole and a center of the second through hole.

Conventionally, the connection between the electrode pad and the lead portion is formed by through hole conductors formed on inner peripheral surfaces of first and second through holes. As a result, it has been necessary to make a joint portion of the connection terminal longer than the two through holes, and to perform brazing in a state in which the first and second through holes are covered by the joint portion of the connection terminal. For this reason, the volume of a brazing filler metal becomes large, so that there has been a possibility that the ceramic layer and the brazing filler metal exfoliate from one another due to the difference in thermal expansion between the ceramic layer and the brazing filler metal. By contrast, in the invention, since the connection between the electrode pad and the lead portion is established by the first and second via conductors filled in the first and second through holes, it is unnecessary to cover the first and second through holes by the joint portion. As a result, the joint portion of the connection terminal can be disposed between the center of the first through hole and the center of the second through hole. In turn, the volume of the brazing filler metal for joining the electrode pad and the connection terminal can be made small. Consequently, it is possible to suppress exfoliation due to a difference in thermal expansion between the ceramic layer and the brazing filler metal, and the amount of expensive brazing filler metal to be used can be reduced.

In addition, the distance between the center of the first through hole and the center of the second through hole is preferably not less than 1 mm and not greater than 5 mm. Because the distance between the first through hole and the second through hole is set to not greater than 5 mm, the volume of the joint portion for joining the electrode pad and the connection terminal can be made small. However, if the center-to-center distance between the two via conductors becomes less than 1 mm, stress becomes concentrated in the ceramic layer between the two via conductors, so that there is a possibility of a crack occurring in the ceramic layer. Accordingly, in the invention, as the center-to-center distance between the two via conductors is set to not less than 1 mm, it is possible to suppress the concentration of stress in the ceramic between the two via conductors, thereby making it possible to prevent the generation of cracks.

BRIEF DESCRIPTION OF THE DRAWINGS

FIG. 12 is a diagram illustrating the conditions and results of an experiment.

DESCRIPTION OF REFERENCE NUMERALS

Figure 1:
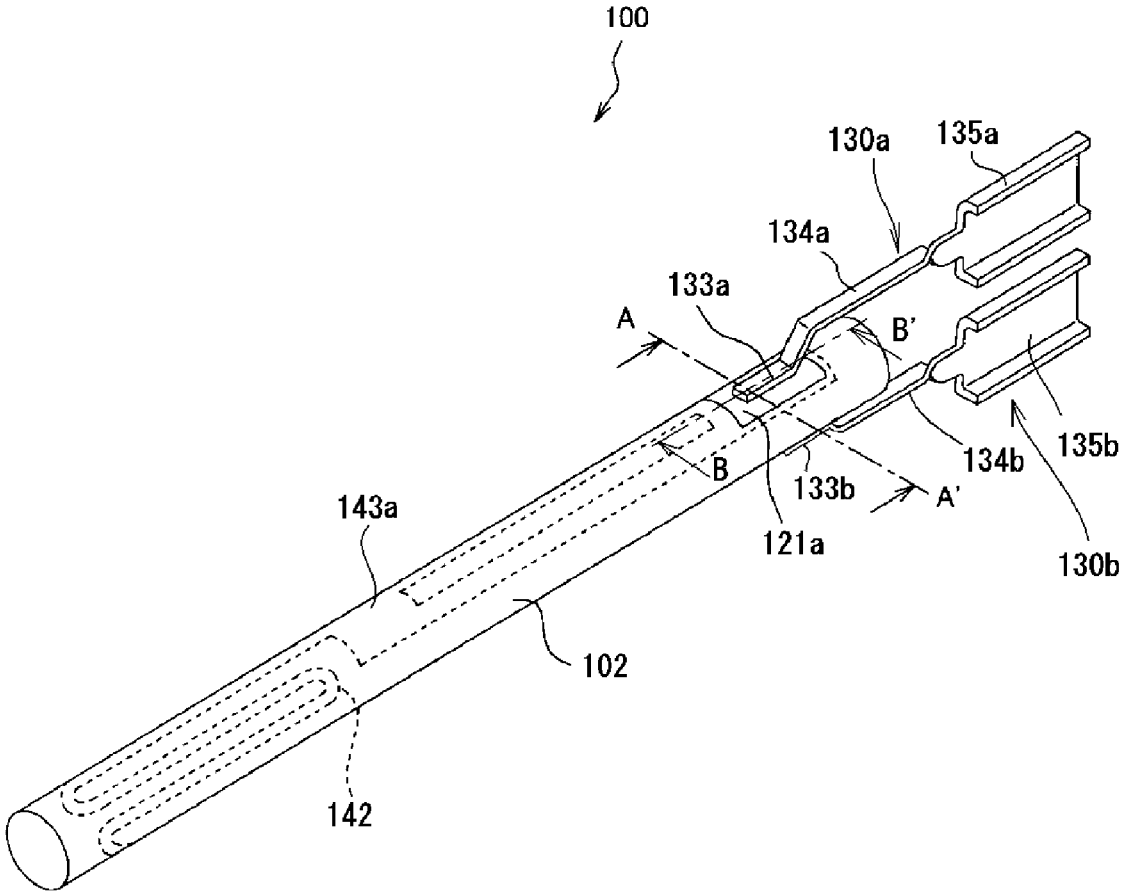
FIG. 1 is a fragmentary perspective view of a ceramic heater.

Reference numerals used to identify various structural features in the drawings include the following.

100: ceramic heater
101: core material
102: ceramic substrate
110: first ceramic layer
120: second ceramic layer (ceramic sheet)
120*a*: outer surface (first surface)
120*b*: inner surface (second surface)
121*a*, 121*b*: electrode pad
122: nickel plating film
124: brazing filler metal
125: nickel layer
130*a*, 130*b*: connection terminal
133*a*, 133*b*: joint portion
142: heating portion
143*a*, 143*b*: lead portion
144*a*, 144*b*, 144*c*, 144*d*: through hole
145*a*, 145*b*, 145*c*, 144*d*: via conductor

DETAILED DESCRIPTION OF THE INVENTION

Referring now to the accompanying drawings, a description will be given of an embodiment of the invention. However, the present invention should not be construed as being limited thereto.

(1) Overall Configuration

Referring to the drawings, a description will be given of a ceramic heater and a method of manufacturing a ceramic heater in accordance with an embodiment of the invention.

It should be noted that the ceramic heater of this embodiment can be used in various applications such as for heating a sensor element up to an activation temperature. Sensor elements subject to heating and which can be adapted for use together with the ceramic heater of the invention include, for example, a gas sensor element for detecting a specific gas (e.g., oxygen) in gases subject to measurement (e.g., exhaust gases). Such sensors are typically used in various control apparatuses (e.g., air/fuel ratio feedback control) in various internal combustion engines of automobiles and the like.

First, referring to FIGS. 1 and 2, a description will be given of the structure of a ceramic heater 100.

FIG. 1 is a perspective view illustrating the outer appearance of the ceramic heater 100. FIG. 2 is an exploded perspective view illustrating an internal structure of the ceramic heater 100.

As shown in FIG. 1, the ceramic heater 100 is formed in the shape of a round rod (substantially cylindrical shape), and is inserted into a sensor element (not shown) having a bottomed cylindrical shape so as to heat the sensor element. The sensor element is constructed with electrode layers respectively formed on inner and outer surfaces of a solid electrolyte body having a bottomed cylindrical shape.

The ceramic heater 100 includes a ceramic substrate 102; a heating portion 142 and a lead portion 143 incorporated in the ceramic substrate 102; electrode pads 121*a* and 121*b* provided on an outer surface of the ceramic substrate 102; and connection terminals 130*a* and 130*b* respectively joined to the electrode pads 121*a* and 121*b* by an electrically conductive brazing filler metal.

Figure 2:
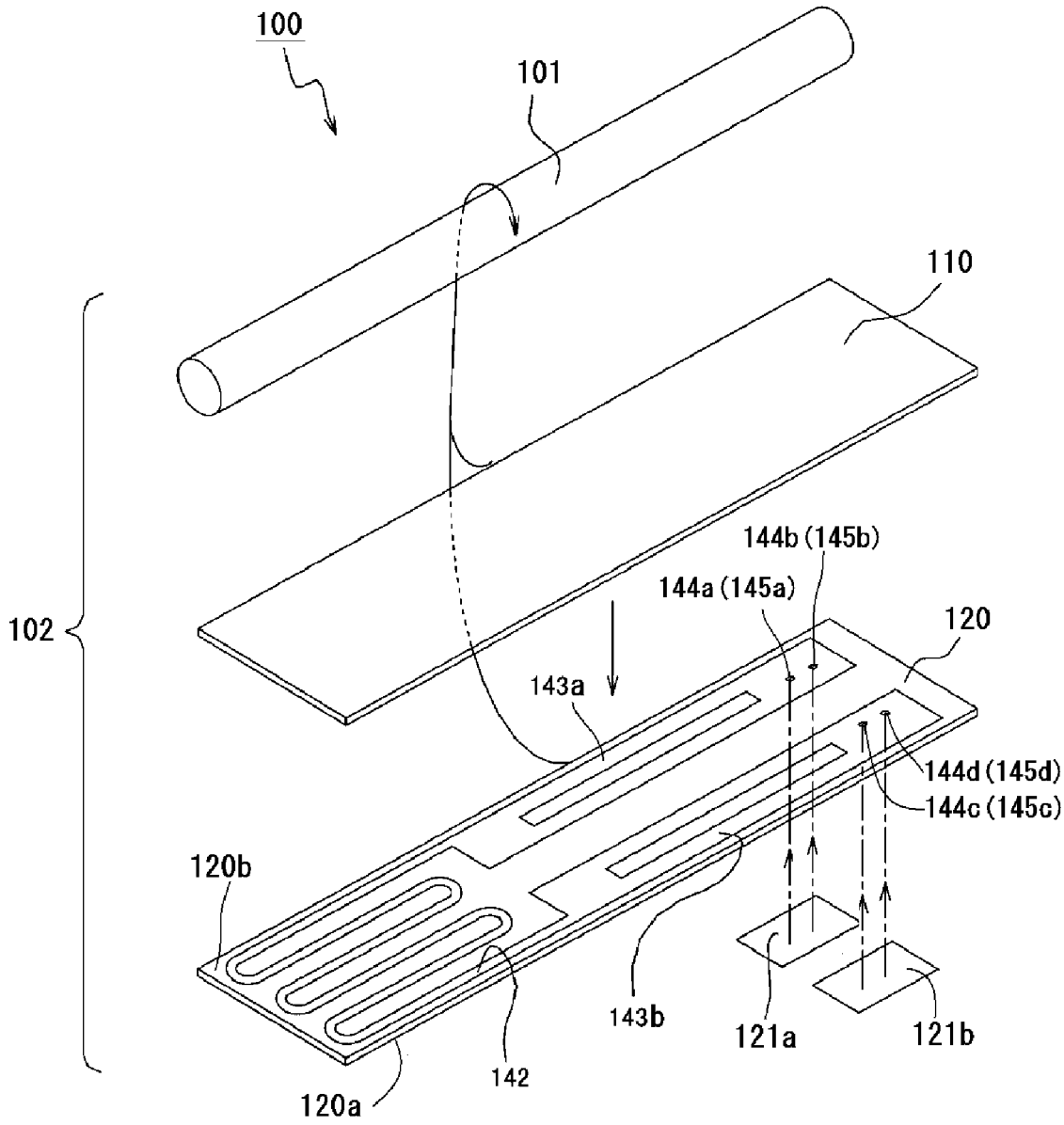
FIG. 2 is an exploded perspective view of constituent elements of the ceramic heater.

As shown in FIG. 2, the ceramic substrate 102 consists of an alumina ceramic-made core material 101 formed in the shape of a round rod as well as first ceramic layer 110 and a second ceramic layer 120 laminated on its outer periphery. The outside diameter of the ceramic substrate 102, i.e., at the outer surface of the second ceramic layer 120 covering core material 101, is 2.5 mm to 3.0 mm (2.8 mm in this embodiment).

The heating portion 142 and a pair of lead portions 143*a* and 143*b* which are respectively connected to both ends of the heating portion 142 are formed on an inner surface of the second ceramic layer 120. The heating portion 142 and the lead portions 143*a* and 143*b* are formed of a tungsten-based material. Further, four through holes 144*a*, 144*b*, 144*c* and 144*d* are provided in the second ceramic layer 120, and via conductors 145*a*, 145*b*, 145*c* and 145*d* for respectively filling them are formed. The pair of lead portions 143*a* and 143*b* are respectively electrically connected to the electrode pads 121*a* and 121*b* formed on an outer surface 120*a* of the second ceramic layer 120, each through two via conductors, i.e., through 145*a* and 145*b* and through 145*c* and 145*d*. It should be noted that a metal layer formed by the plating described below (a nickel plating film 122 shown in FIG. 3) is formed on the surface of each electrode pad 121*a*, 121*b*.

In addition, the connection terminals 130*a* and 130*b* are composed of nickel members containing not less than 90% by weight of nickel. The connection terminals 130*a* and 130*b* respectively have joint portions 133*a* and 133*b*, each of which are brazed to the electrode pad 121*a*, 121*b*; crimping portions 135*a* and 135*b* for crimping and fixing a lead wire for connection to an external circuit (external power supply unit); and connecting portions 134*a* and 134*b* for connecting the joint portions to respective crimping portions. The connection terminals 130*a* and 130*b* are respectively joined to the electrode pads 121*a* and 121*b* and function as a cathode side terminal and an anode side terminal when a voltage is applied to the ceramic heater 100.

Figure 3:
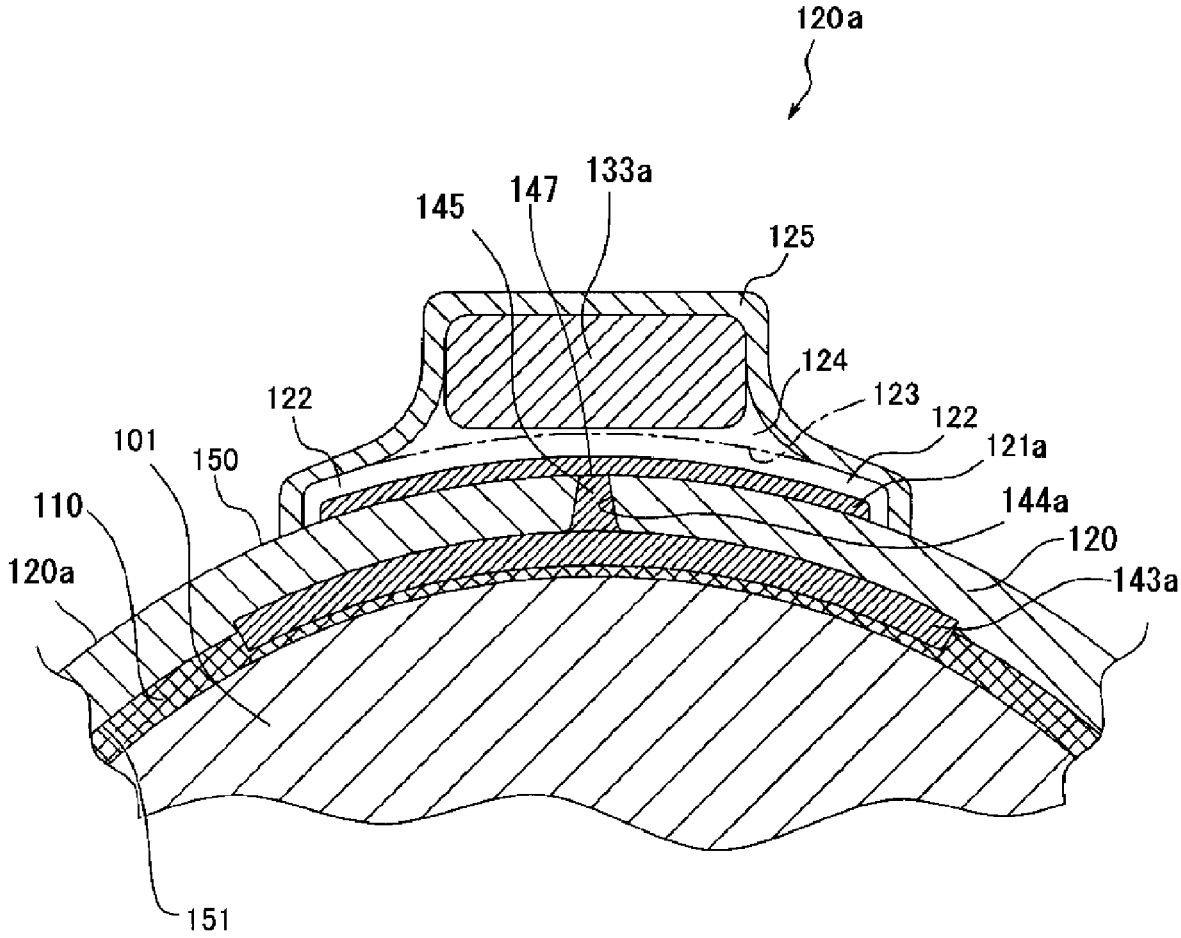
FIG. 3 is a partial enlarged cross-sectional view, taken in the direction of arrows along a chain line A-A' in FIG. 1, of a through hole and vicinity thereof in the ceramic heater.

Next, referring to FIGS. 3 and 4, a description will be given of the structure of the through holes 144*a* and 144*b*. FIG. 3 is a partial enlarged cross-sectional view of the electrode pad 121*a* and vicinity thereof in the ceramic heater 100 shown in FIG. 1, the view being taken in the direction of arrows along a chain line A-A' and perpendicular to the axial direction of the ceramic heater 100. Meanwhile, FIG. 4 is a partial enlarged cross-sectional view of the electrode pad 121*a* and vicinity thereof in the ceramic heater 100 shown in FIG. 1, the view being taken in the direction of arrows along a chain line B-B' and along the axial direction of the ceramic heater 100.

Figure 4:
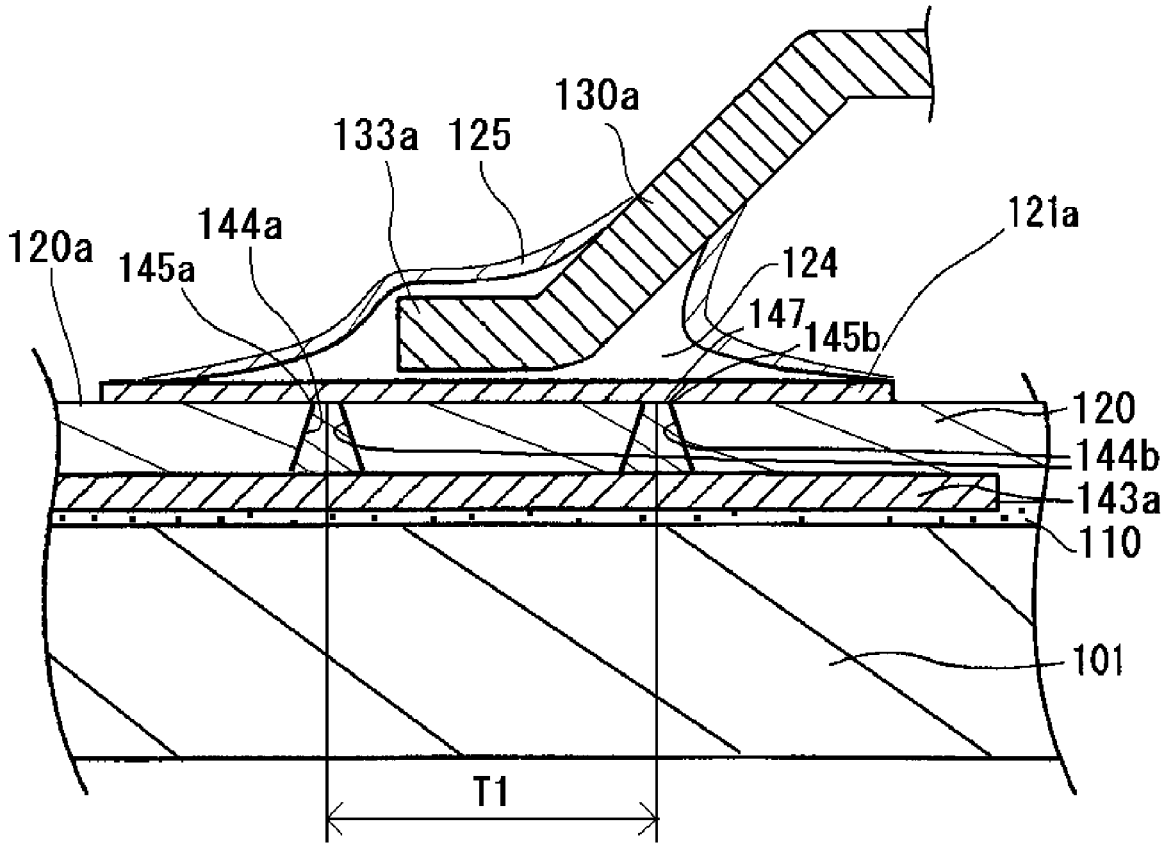
FIG. 4 is a partial enlarged cross-sectional view, taken in the direction of arrows along a chain line B-B' in FIG. 1, of through holes and vicinities thereof the ceramic heater.

As shown in FIGS. 3 and 4, the electrode pad 121*a* is formed on the outer surface 120*a* of the second ceramic layer 120 and electrically conducts with the lead portion 143*a* formed on an inner surface 120*b* of the second ceramic layer 120 through the via conductor 145*a* filled in the through hole 144*a*.

As shown in FIG. 3, the connection terminal 130*a* (specifically, joint portion 133*a*) is joined to the electrode pad 121*a* by a brazing filler metal 124. A nickel layer 125 formed by nickel plating is further formed on the connection terminal 130*a* and the electrode pad 121*a* joined to one another by the brazing filler metal 124, so as to prevent corrosion due to oxidation.

Further, the brazing filler metal 124 for joining the electrode pad 121*a* and the connection terminal 130*a* contains copper in an amount exceeding 50% by weight. It should be noted that, in this embodiment, the electrode pad 121*a* and the connection terminal 130*a* are brazed using a brazing filler metal 124 containing 62% by weight of copper and 38% by weight of gold.

The electrode pad 121*a* is a metal layer containing not less than 80% by weight of a principal constituent composed of at least one kind of element selected from tungsten and molybdenum. Tungsten and molybdenum have good joinability with the copper-based brazing filler metal 124, and have high melting points and excellent heat resistance, so that they are suitable as the composition of the electrode pad 121*a*.

It should be noted that although, before brazing, the nickel plating film 122 shown by a chain line 123 in FIG. 3 is formed on the electrode pad 121*a*, the nickel component during brazing is diffused to the brazing filler metal 124. The state after brazing is such that part of the nickel plating film 122 diffuses into and is dissolved in the brazing filler metal 124, so that the nickel plating film 122 and the brazing filler metal 124 are formed in an integrated state.

Further, as shown in FIG. 4, when a first cross section passing through the centers of the through holes 144*a* and 144*b* is viewed, each of the through holes 144*a* and 144*b* is diametrically enlarged from the outer surface 120*a* toward the inner surface 120*b* of the second ceramic layer 120 in a reversely tapered manner. Hence, even if stress directed from the inner surface 120*b* side toward the outer surface 120*a* side is applied to the via conductors 145*a* and 145*b* filled in the through holes 144*a* and 144*b*, the stress can be suppressed by the inner peripheral surfaces of the through holes 144*a* and 144*b*. As a result, it is possible to suppress the occurrence of cracks in the through holes 144*a* and 144*b* and their peripheries even in a ceramic heater 100 in which the outside diameter of the ceramic substrate 102 including the second ceramic layer 120 is small and not greater than 3.0 mm as in this embodiment.

In addition, as shown in FIG. 3, when a second cross section passing through the through hole 144*a* and perpendicular to the axial direction is viewed, the via conductor 145*a* filled in the through hole 144*a* is diametrically enlarged from the outer surface 120*a* toward the inner surface 120*b* of the second ceramic layer 120 in a reversely tapered manner. Since the through hole 144*a* is diametrically enlarged from the outer surface 120*a* toward the inner surface 120*b* of the second ceramic layer 120, even if stress directed from the inner surface 120*b* side toward the outer surface 120*a* side is applied to the via conductor 145*a* filled in the through hole 144*a*, the stress can be suppressed by the inner peripheral surface of the through hole 144*a*. As a result, even in the ceramic heater 100 in which the outside diameter of the ceramic substrate 102 is small and not greater than 3.0 mm as in this embodiment, displacement is unlikely to occur between the through hole 144*a* and the via conductor 145*a*, so that it is possible to further suppress the occurrence of cracks in the through hole 144*a* and its periphery.

The outer surface of the via conductor 145*a* is a smooth surface extending along the outer surface 120*a* of the second ceramic layer 120. As a result, even if the outer surface of the second ceramic layer 120 is subjected to a larger stress than the inner surface thereof, the occurrence of cracks can be suppressed as compared with a case where the outer surface of the via conductor 145 is not smooth.

The inner surface 120*b* of the second ceramic sheet 120 has a surface roughness that is smaller than that of the outer surface 120*a*. As a result, it is possible to prevent unintended variation in resistance values and characteristics of the heating portion 142 and the lead portions 143*a*, 143*b* formed on the inner surface 120*b*.

The diameter of each of the through holes 144*a*, 144*b* on the outer surface side in the first cross section shown in FIG. 4 is 0.43 mm, while the diameter of the through hole 144*a* on the outer surface side in the second cross section shown in FIG. 3 is 0.45 mm and is slightly larger than the diameter on the outer surface side in the first cross section, but their diameters fall within the range of 0.4 to 0.5 mm in both cases. Because the diameter of the through hole 144*a* on the outer surface side is made so as not to be greater than 0.5 mm, the stress directed from the inner surface side toward the outer surface side and applied to the via conductor 145*a* filled in the through hole 144*a* can be made small, thereby making it possible to further suppress the occurrence of cracks in the through hole 144*a* and its periphery. It should be noted that the diameter of each of the through holes 144*a* and 144*b* on the inner surface side is 0.6 mm in each cross section. A difference in diameter of each of the through holes 144*a* and 144*b* between the outer surface side and the inner surface side in the first cross section (FIG. 4) is 0.17 mm, while a difference in the diameter of the through hole 144*a* between the outer surface side and the inner surface side in the second cross section (FIG. 3) is 0.15 mm and is slightly smaller than the diametrical difference in the first section (FIG. 4).

The difference in diameter of the through hole when viewed in the second and first cross sections is discussed in greater detail as follows. Namely, if the ceramic sheet (second ceramic layer 120) is formed to have a through hole of straight form (not diametrically enlarged), when the core material 101 is covered with such sheet (i.e., when such sheet is provided around the core material), the sheet is deformed so that the diameter at the outer surface side, when viewed at the second cross section, is enlarged. Therefore, even if the sheet (before it is provided around the core material) is formed so as to have a through hole that is diametrically enlarged from an outer surface 120*a* to an inner surface 120*b*, when the difference in diameter at the outer and inner surfaces is small, there is a possibility that the through hole may, after the sheet is provided around the core material, assume a straight form or may be diametrically enlarged from an inner surface to an outer surface. This is due to deformation when the sheet is provided around the core material. On the other hand, such deformation is not observed when viewed at the first cross section.

As shown in FIG. 4, the joint portion 133*a* of the connection terminal 130*a* is disposed between the center of the through hole 144*a* and the center of the through hole 144*b*. Since the through holes 144*a* and 144*b* are respectively filled with the via conductors 145*a* and 145*b*, it is unnecessary to carry out brazing in such manner that the joint portion 133*a* covers the through holes 144*a* and 144*b*. Further, the volume of the brazing filler metal 124 becomes small, so that it is possible to suppress exfoliation due to a difference in thermal expansion between the second ceramic layer 120 and the brazing filler metal 124.

In addition, as shown in FIG. 4, a distance T1 between the centers of the two through holes 144*a* and 144*b* is 1.5 mm. As the center-to-center distance between the two via conductors 145*a*, 145*b* is thus set to not less than 1 mm, it is possible to suppress the concentration of stress on the second ceramic layer 120 between the through holes 144*a* and 144*b* and to suppress the occurrence of cracks in the second ceramic layer 120.

The above description relating to electrode pad 121*a*, through holes 144*a* and 144*b*, via conductors 145*a* and 145*b*, connection terminal 130*a*, joint portion 133*a* and connecting portion 134*a* applies to corresponding electrode pad 121*b*, through holes 144*c* and 144*d*, via conductors 145*c* and 145*d*, connector terminal 130*b*, joint portion 133*b* and connecting portion 134*b*, respectively.

(2) Manufacturing Method

Next, referring to FIGS. 5 and 6, a description will be given of a method of manufacturing the ceramic heater 100.

First, the second ceramic layer 120 is punched out from its first surface 120*a* toward its second surface 120*b* (see FIG. 5A) to form the through hole 144*a* (since the same applies to the other through holes 144*b*, 144*c* and 144*d*, a description thereof will be omitted). In other words, a tool (punch) 1 for punching first comes into contact with the first surface 120*a* in the ceramic layer 120.

Here, punching is performed by setting, as the first surface, that surface of the second ceramic layer 120 having a greater surface roughness.

For example, consider the case where the second ceramic layer 120 is fabricated by a method (a doctor blade method) in which a ceramic slurry is passed into a nip between a transport tape and a blade disposed at a position opposing the surface of the transport tape while the ceramic slurry is being transported by the transport tape. Since the surface roughness of the surface on the side which was not in contact with the transport tape is relatively large (e.g., a maximum height Ry of 2 to 3 μm), this surface is set as the first surface. On the other hand, since the surface roughness of the surface which was in contact with the transport tape is relatively small (e.g., a maximum height Ry of not greater than 1 μm), this surface is set as the second surface.

At the time of punching a through hole 144*a*, the area of the second ceramic layer 120 in contact with the punching tool 1 and its peripheral area are both pulled in the punching direction. Therefore, on the second surface side, the area in contact with the tool 1 and a portion of its peripheral area both fall off. As a result, the through hole 144*a* is usually formed in a shape in which the second surface side is more enlarged than the first surface side (see FIG. 5B).

Figure 5A:
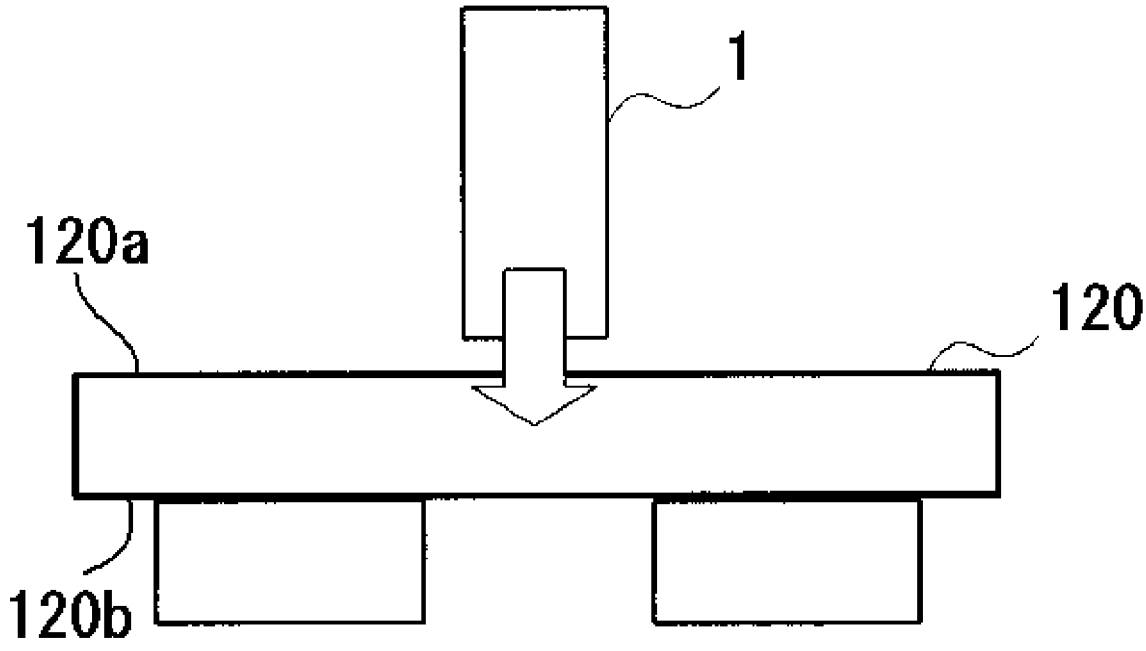
FIGS. 5A and 5B are diagrams illustrating a method of manufacturing a ceramic heater (punching step)
Figure 5B:
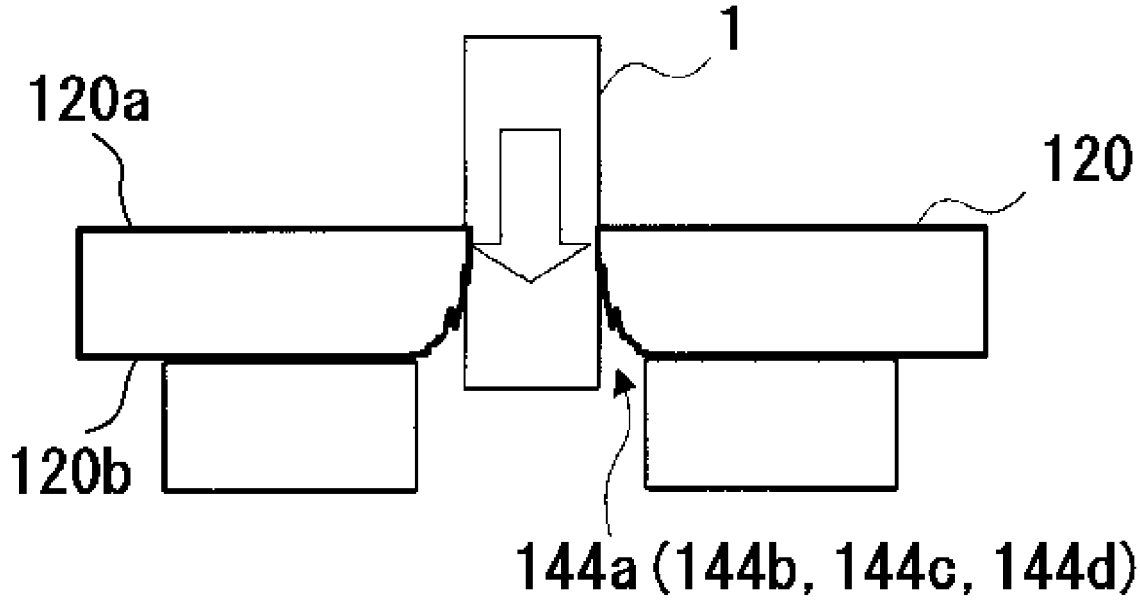

In more detail, in order to make the diametrically enlarged through hole (i.e., in order to control the difference in diameter of the through hole at the first surface 120*a* and the second surface 120*b*), as shown in FIGS. 5A and 5B, the difference between the diameter of the male component (the punching tool 1 shown in FIGS. 5A and 5B) and the diameter of the female component (member provided just below the member 120 in FIGS. 5A and 5B) is adjusted. If the difference in diameter of the male and female components is small, the through hole tends to have a relatively straight form. If the difference in diameter is large, the through hole tends to be diametrically enlarged. The diameter of the male component corresponds to the smaller diameter side of the through hole, and the diameter of the female component corresponds to the larger diameter side of the through hole. In practice, the punching is carried out so that the punched through hole has diameters somewhat larger than the diameters of the desired final product, in view of sintering shrinkage.

Figure 7:
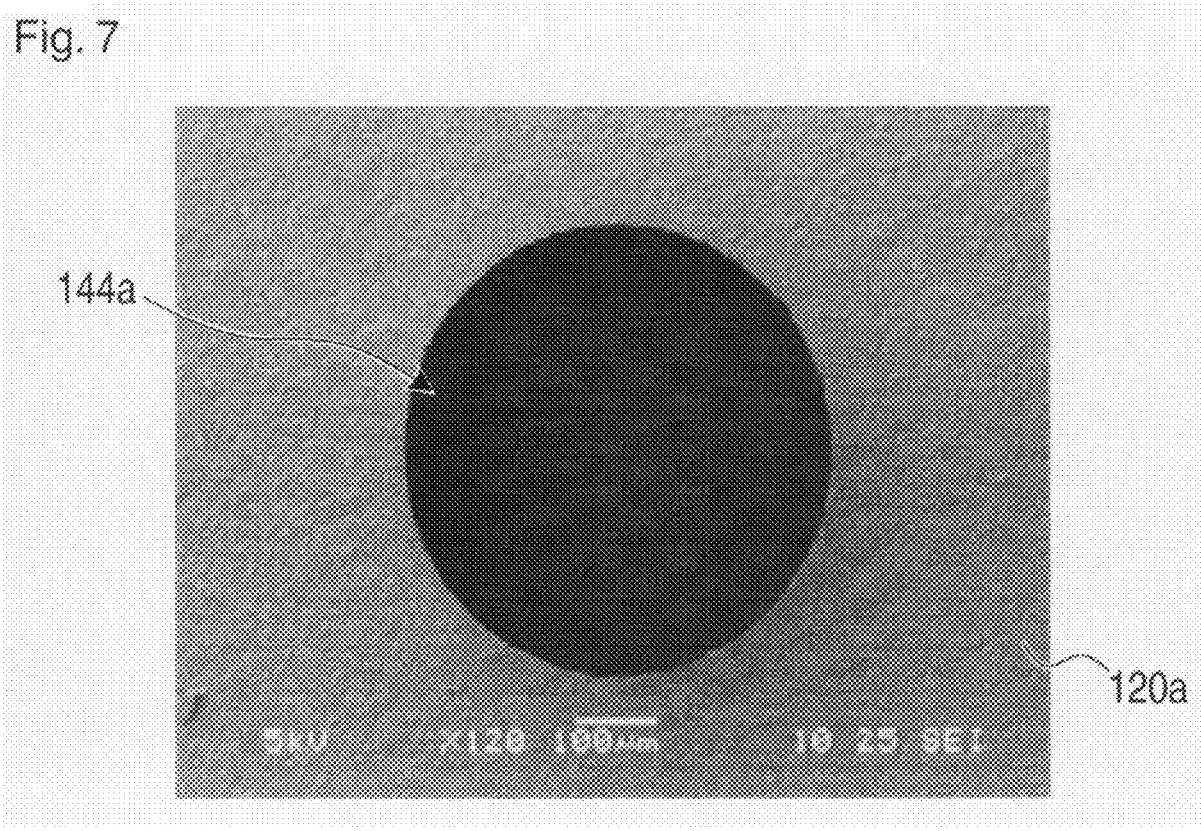
FIG. 7 is an electron micrograph of the through hole and its periphery (first surface side)
Figure 8:
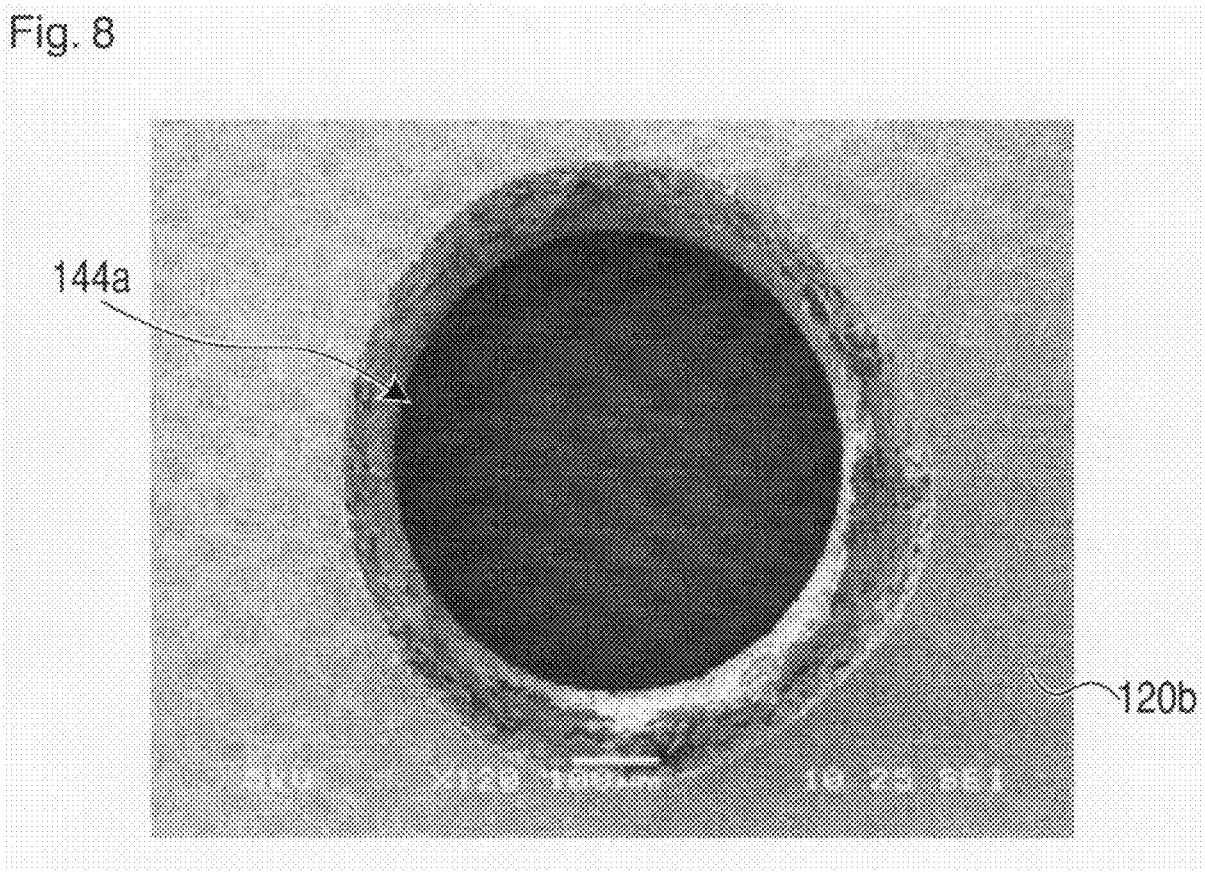
FIG. 8 is an electron micrograph of the through hole and its vicinity (second surface side)

FIG. 7 is an electron microscopic view of this through hole 144*a* and its periphery on the first surface side, and FIG. 8 is an electron microscopic view thereof on the second surface side.

Subsequently, the via conductor 145*a* is formed in the through hole 144*a* formed in the above-described punching procedure.

Here, after the obverse and reverse sides of the second ceramic layer 120 with the through hole 144*a* formed therein in the punching procedure are inverted, the first surface 120*a* is brought into contact with a smooth plate 2 to close the through hole 144*a*. In this state, an electrically conductive paste 5 is pushed and filled into the through hole 144*a* by a squeegee 4 through a mask 3 from the second surface 120*b* side in this second ceramic layer 120, thereby forming the via conductor 145*a* in the through hole 144*a* (see FIGS. 6A, 6B, and 2).

At this time, since the through hole 144*a* is closed by the smooth plate 2, the first surface (120*a*-side surface) of the via conductor 145*a* assumes the same height as that of the first surface 120*a* of the second ceramic layer 120 and becomes a smooth planar surface.

Figure 6A:
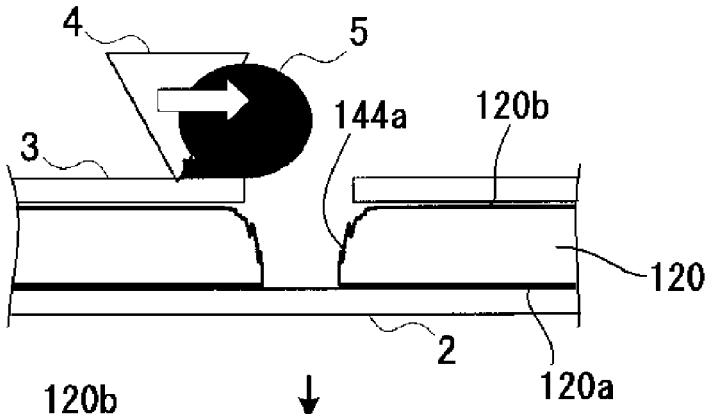
FIGS. 6A to 6F are diagrams illustrating the method of manufacturing a ceramic heater (via conductor forming procedure up to a covering step)
Figure 6B:
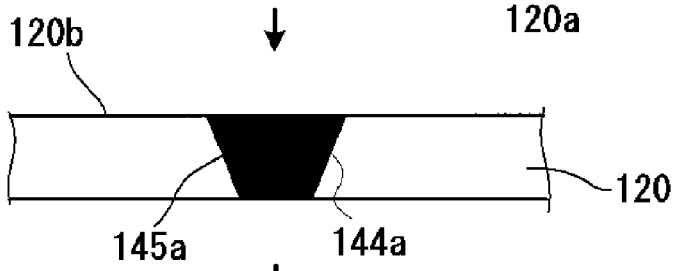
Figure 6C:
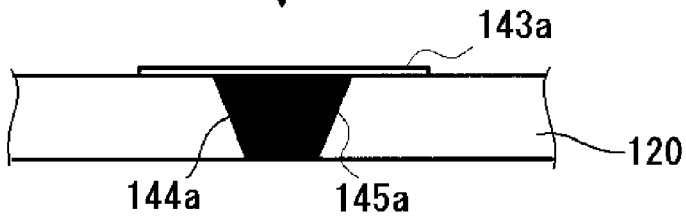
Figure 6D:
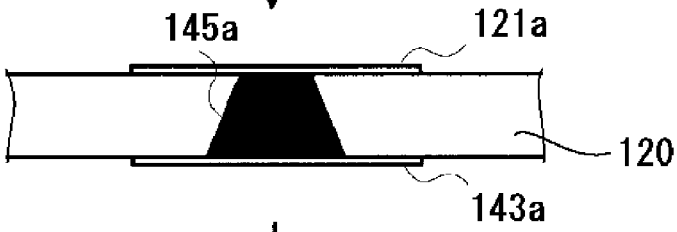

Subsequently, the heating portion 142 and the lead portions 143*a* and 143*b* are formed on the second surface 120*b* having a smaller surface roughness by printing (see FIGS. 6C and 2). The lead portion 143*a* is formed so as to cover the via conductors 144*a* and 144*b*, and the lead portion 143*b* is formed so as to cover the via conductors 144*c* and 144*d*. However, in FIG. 6, only the via conductor 144*a* is shown, and the rest are omitted.

Figure 6E:
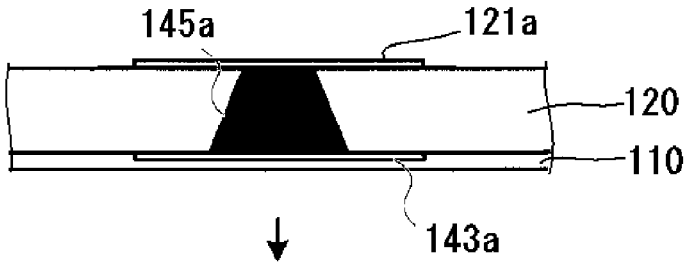

Subsequently, after inversion of the obverse and reverse sides, the electrode pads 121*a* and 121*b* (only 121*a* is shown) are formed on the first surface 120*a* of the second ceramic layer 120 by printing (see FIG. 6D), and then the first ceramic layer 110 is pressure bonded to the second surface 120*b* (see FIG. 6E).

Figure 6F:
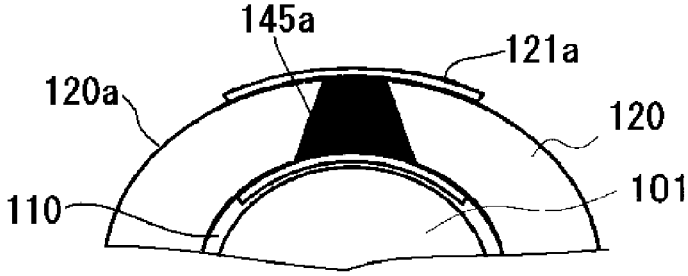

Next, the core material 101 is covered with the laminated body of the first ceramic layer 110 and the second ceramic layer 120 to thereby form a cylindrical formed body (see FIG. 6F).

After sintering the formed body, the ceramic heater 100 shown in FIGS. 1 and 2 is obtained (see FIG. 1).

Figure 9:
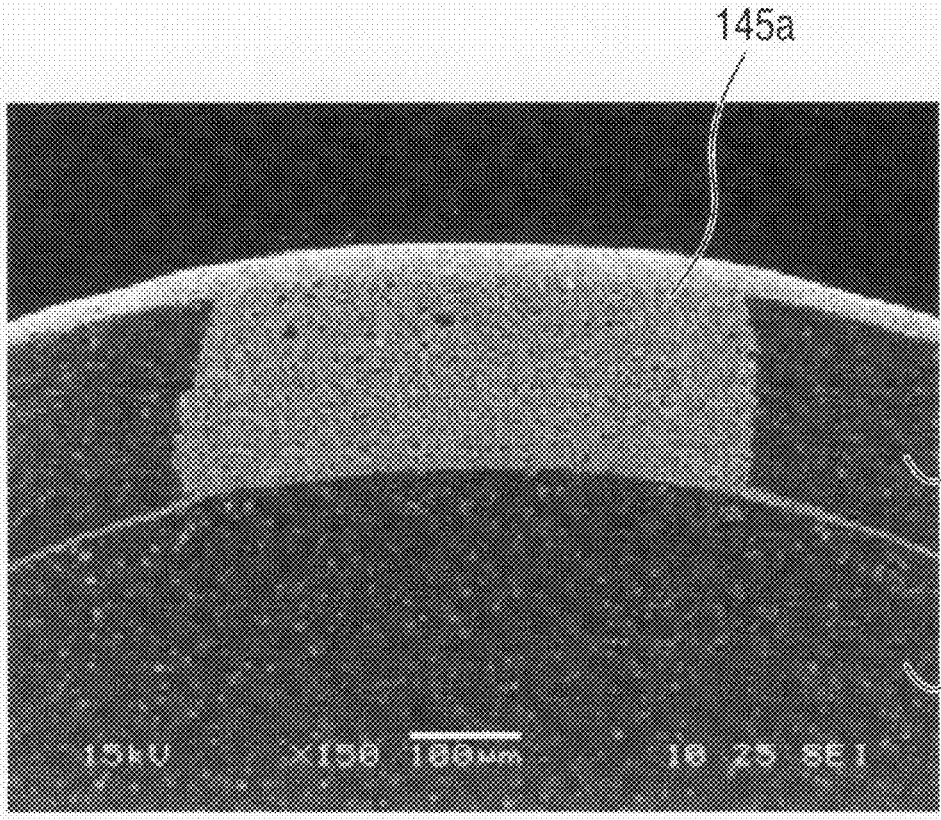
FIG. 9 is an electron micrograph of a cross section of the ceramic heater.

FIG. 9 is an electron microscopic view of a cross section, cut along the longitudinal direction, of the ceramic heater 100 thus fabricated.

According to the above-described manufacturing method, the core material 101 is covered with the second ceramic layer 120 by setting as its outer side the first surface 120*a* with which the processing tool (punch) 1 is first brought into contact when the through holes 144*a*, 144*b*, 144*c* and 144*d* are punched. At this time, the through holes 144*a*, 144*b*, 144*c* and 144*d* and the via conductors 145*a*, 145*b*, 145*c* and 145*d* are shaped so as to be diametrically enlarged from the first surface 120*a* toward the second surface 120*b* of the second ceramic layer 120 in a reversely tapered manner (see FIG. 9).

The ceramic heater 100 thus manufactured is able to substantially lower the probability of occurrence of cracks as compared with a case where the core material is covered with the second ceramic layer 120 by setting as its inner side the surface (first surface 120*a*) with which the tool 1 is first brought into contact, as shown by an experimental result described below.

In addition, in the ceramic heater 100 manufactured by the above-described manufacturing method, the surfaces of the via conductors 145*a*, 145*b*, 145*c* and 145*d* on the first surface 120*a* side have been made smooth. As a result, it is possible to suppress the occurrence of cracks as compared with a case where there is an irregularity on the first surface of the second ceramic layer 120 in the via conductor 145, as shown in the experimental result described below.

In the above-described manufacturing method, the heating portion 142 and the lead portions 143*a* and 143*b* are formed on the second surface 120*b* of the second ceramic layer 120. This second surface is the surface whose surface roughness is smaller between the observe surface and the reverse surfaces of the second ceramic layer 120. Thus, the effect of irregularities on the heater can be made small, so that it is possible to prevent unintended variation in characteristics.

Although an embodiment of the invention has been described above, the invention is not limited thereto, and various modifications may be adopted insofar as they fall within the technical scope of the invention.

For example, in the above-described embodiment, a construction in which the core material 101 is formed in the shape of a round rod has been illustrated by way of example. However, it is possible to use a material having a columnar shape, a plate shape, or any other shape insofar as it has a shape capable of serving as a core material.

In addition, in the above-described embodiment, a construction in which a brazing filler metal containing 62% by weight of copper and 38% by weight of gold is used as the brazing filler metal 124 has been illustrated by way of example. However, it is possible to use a known brazing filler metal, and a copper brazing filler metal containing 2% to 45% by weight of gold is preferred.

The results of an experiment for determining whether or not a crack developed in the case where cylindrical ceramic heaters, each having a ceramic layer with which the rod-shaped core material was covered, were manufactured according to a plurality of kinds of manufacturing methods shown below. It should be noted that the ceramic sheet used here was fabricated by the above-described doctor blade method, and the maximum height Ry of the first surface was 2 to 3 μm, while the maximum height Ry of the second surface was not greater than 1 μm.

In this experiment, a plurality of ceramic heaters were respectively manufactured by three manufacturing methods in which only the punching procedure and the via conductor forming procedure differed among the various procedures in the above-described manufacturing method, and the through holes and their peripheries on the outer peripheral surface (second ceramic layer) were examined using an electron microscope. The core material was covered with the second ceramic layer such that the surface (first surface) whose surface roughness was greater between the obverse surface and the reverse surface of the second ceramic layer faced the outside. The outside diameter of the substrate once the second ceramic layer was provided around the core material was 2.8 mm.

Specific conditions of Manufacturing Methods 1 to 3 are as follows.

Manufacturing Method 1:

In the punching procedure, punching was performed from the second surface toward the first surface contrary to the above-described embodiment. In addition, in the via conductor forming procedure, contrary to the above-described embodiment, a smooth plate was brought into contact with the second surface to close the through hole. In this state, an electrically conductive paste was pushed into the through hole from the first surface side, thereby forming the via conductor in the through hole.

Manufacturing Method 2:

In the punching procedure, punching was performed from the first surface toward the second surface in the same way as the above-described embodiment. On the other hand, in the via conductor forming procedure, in the same manner as Manufacturing Method 1, a smooth plate was brought into contact with the second surface to close the through hole. In this state, an electrically conductive paste was pushed into the through hole from the first surface side, thereby forming the via conductor in the through hole.

Manufacturing Method 3:

In the punching procedure, punching was performed from the first surface toward the second surface in the same way as the above-described embodiment. On the other hand, in the via conductor forming procedure, in the same manner as the above-described embodiment, a smooth plate was brought into contact with the first surface to close the through hole. In this state, an electrically conductive paste was pushed into the through hole from the second surface side, thereby forming the via conductor in the through hole.

Figure 10:
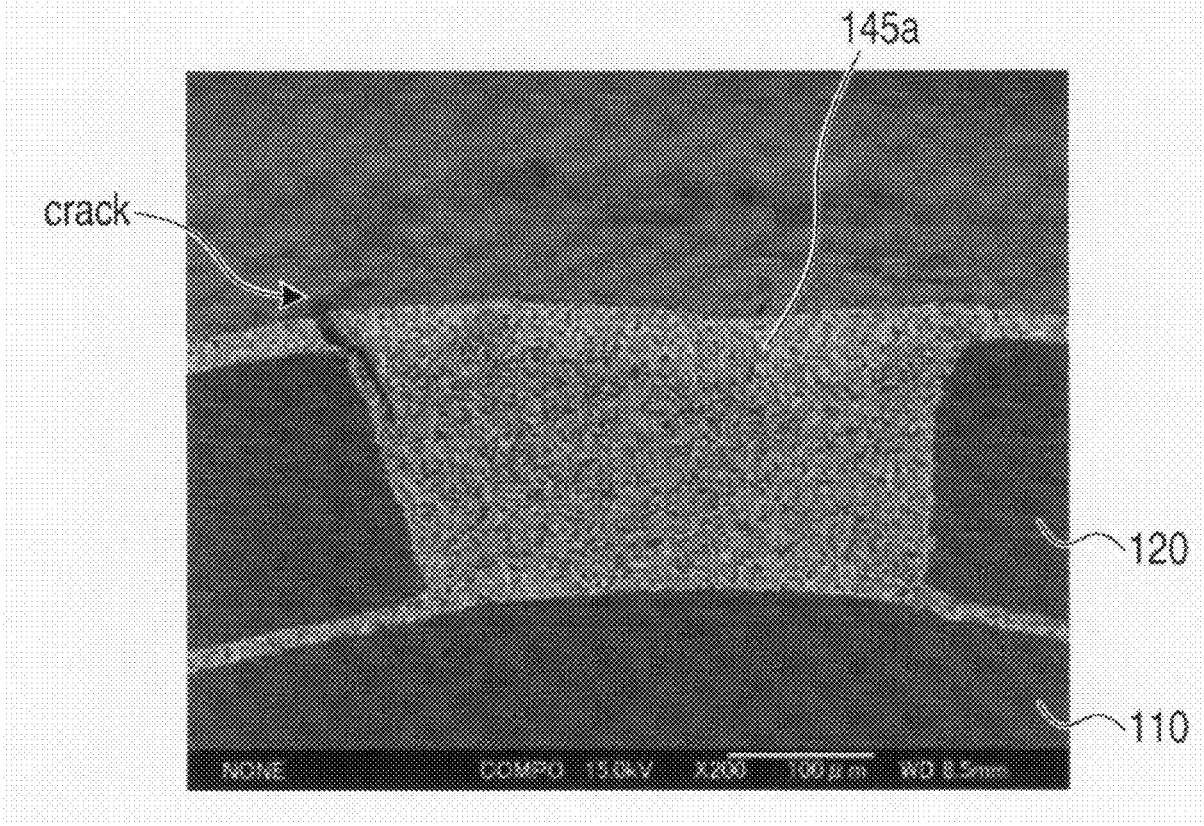
FIG. 10 is an electron micrograph of a cross section of the ceramic heater where a crack has developed.
Figure 11:
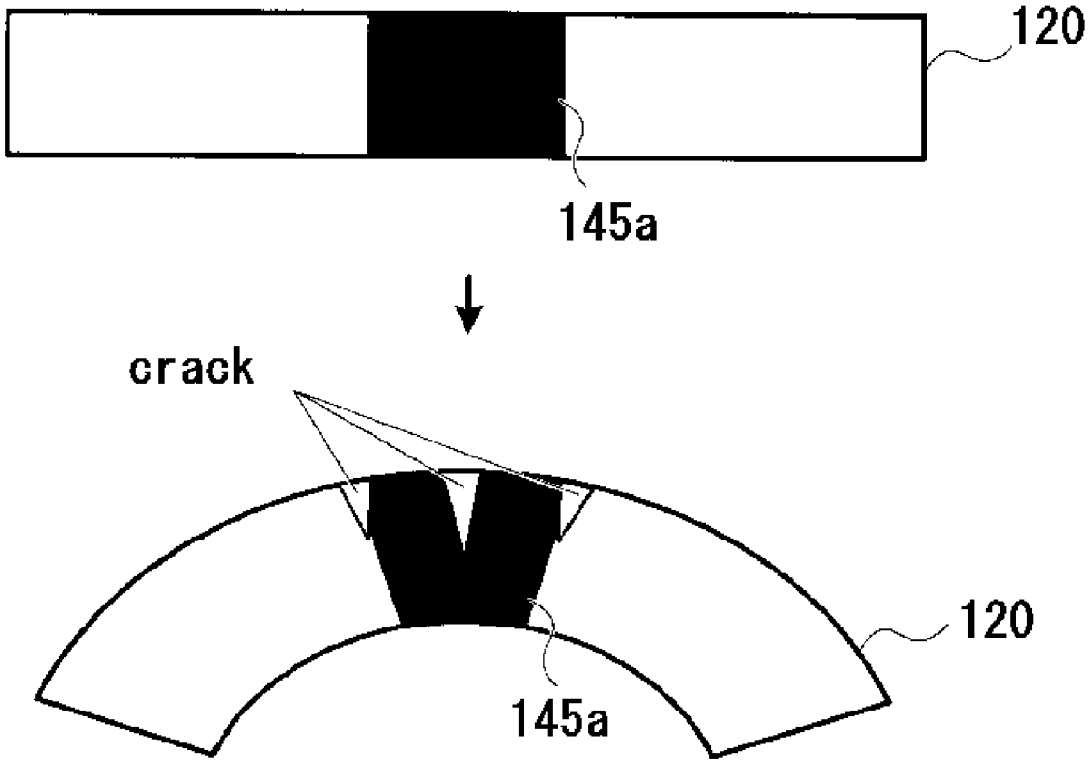
FIG. 11 is a diagram explaining the cause of cracks occurring in the through hole and its periphery.

As a result of examining the through holes and their peripheries on the surfaces of the ceramic heaters manufactured by the above-described Manufacturing Methods 1 to 3, cracks developed in all of the samples. FIG. 10 is an electron micrograph of a region where a crack occurred. This is conceivably due to the fact that the ceramic sheet was deformed in the direction in which the through hole was enlarged, owing to the stress (tensile stress) occurring when the core material was covered with the ceramic sheet (second ceramic layer). As such, a region which could not withstand the deformation was broken, resulting in a crack (see FIG. 11).

However, the rate of occurrence of cracks differed substantially among the manufacturing methods. Specific crack occurrence rates were as follows:

Manufacturing Method 1: 100%

Manufacturing Method 2: 20%

Manufacturing Method 3: 9%

The conditions of the respective manufacturing methods and the crack occurrence rates are shown in FIG. 12.

From these results, the present inventors found that the crack occurrence rate is remarkably reduced in the case where punching is performed from the first surface side than in the case where punching is performed from the second surface side.

In addition, the present inventors found that the crack occurrence rate is reduced in the case where the via conductor is filled from the second surface side than in the case where the via conductor is filled from the first surface side.

It should further be apparent to those skilled in the art that various changes in form and detail of the invention as shown and described above may be made. It is intended that such changes be included within the spirit and scope of the claims appended hereto.

This application is based on Japanese Patent Application JP 2006-201041, filed Jul. 24, 2006, the entire content of which is hereby incorporated by reference, the same as if set forth at length.

What is claimed is:

1. A method for manufacturing a ceramic heater, including a core material and a ceramic sheet covering said core material, and wherein a side of the ceramic sheet opposite the core material is an outer side of the ceramic heater, said method comprising:

forming a through hole in a ceramic sheet which is diametrically enlarged from a first surface toward a second surface of the ceramic sheet by punching the ceramic sheet from the first surface toward the second surface of the ceramic sheet;

forming a via conductor by filling an electrically conductive paste in the through hole;

forming on the second surface a heating portion and a lead portion for connecting the heating portion and the via conductor; and covering a core material with the ceramic sheet such that the first surface faces the outer side of the ceramic heater.

2. The method as claimed in claim 1, which comprises forming the via conductor by filling the electrically conductive paste from the second surface side of the through hole in a state in which the first surface side of the through hole is closed by a smooth plate.

3. The method as claimed in claim 1, wherein the second surface of the ceramic sheet has a surface roughness that is smaller than that of the first surface.

4. A ceramic heater comprising:

a cylindrical ceramic layer extending in an axial direction;

a first through hole penetrating the ceramic layer;

a first via conductor filled in the first through hole;

an electrode pad provided on an outer surface of the ceramic layer so as to be connected to the first via conductor;

a heating portion provided on an inner surface of the ceramic layer; and a lead portion provided on the inner surface of the ceramic layer so as to connect the heating portion and the first via conductor, wherein, in a first cross section passing through a center of the first through hole and extending along the axial direction, the first through hole is diametrically enlarged from the outer surface toward the inner surface of the ceramic layer.

5. The ceramic heater as claimed in claim 4, wherein a diameter at the outer surface of the first through hole is not greater than 0.5 mm in the first cross section.

6. The ceramic heater as claimed in claim 4, wherein, in the first cross section, a difference in diameter of the first through hole between the outer surface and the inner surface of the ceramic layer is from 0.1 mm to 0.2 mm.

7. The ceramic heater as claimed in claim 4, wherein, in a second cross section passing through the center of the first through hole and perpendicular to the axial direction, the first through hole is diametrically enlarged from the outer surface toward the inner surface of the ceramic layer.

8. The ceramic heater as claimed in claim 7, wherein a diameter at the outer surface of the first through hole in the second cross section is greater than the diameter of the outer surface of the first through hole in the first cross section and is not greater than 0.5 mm.

9. The ceramic heater as claimed in claim 4, wherein a difference in diameter of the first through hole between the outer surface and the inner surface in the second cross section is not less than 0.1 mm, and is smaller than the difference in the diameter of the first through hole between the outer surface and the inner surface in the first cross section.

10. The ceramic heater as claimed in claim 4, further comprising:

a connection terminal having a surface abutting the electrode pad;

a second through hole which penetrates the ceramic layer and is diametrically enlarged from the outer surface toward the inner surface of the ceramic layer in the first cross section, said first cross section also passing through a center of the second through hole; and a second via conductor which is filled in the second through hole so as to connect the electrode pad and the lead portion, wherein a joint portion of the connection terminal is disposed between the center of the first through hole and a center of the second through hole.

11. The ceramic heater as claimed in claim 10, wherein a distance between the center of the first through hole and the center of the second through hole is from 1 mm to 5 mm.

12. The ceramic heater as claimed in claim 4, wherein an outside diameter of the ceramic layer in a cross section perpendicular to the axial direction is from 2.5 mm to 3.0 mm.

* * * * *